US011220372B2

(12) United States Patent
Gannaway

(10) Patent No.: US 11,220,372 B2
(45) Date of Patent: Jan. 11, 2022

(54) CONDIMENT CONTAINER

(71) Applicant: Sam Gannaway, Birmingham, AL (US)

(72) Inventor: Sam Gannaway, Birmingham, AL (US)

( * ) Notice: Subject to any disclaimer, the term of this patent is extended or adjusted under 35 U.S.C. 154(b) by 183 days.

(21) Appl. No.: 16/670,385

(22) Filed: Oct. 31, 2019

(65) Prior Publication Data

US 2020/0140147 A1 May 7, 2020

Related U.S. Application Data

(60) Provisional application No. 62/754,083, filed on Nov. 1, 2018.

(51) Int. Cl.
*B65D 25/22* (2006.01)
*B65D 69/00* (2006.01)

(52) U.S. Cl.
CPC ..... *B65D 25/22* (2013.01); *B65D 69/00* (2013.01)

(58) Field of Classification Search
CPC .. A47G 2021/002; A47G 19/26; A47G 19/22; B65D 21/00; B65D 21/0204; B65D 21/0202; B65D 21/0201; B65D 21/02; B65D 25/22; B65D 69/00
See application file for complete search history.

(56) References Cited

U.S. PATENT DOCUMENTS 2,979,301 A * 4/1961 Reveal ..... A47G 23/0216 248/214
4,854,466 A * 8/1989 Lane, Jr. ..... B65D 25/22 220/23.83
5,429,262 A * 7/1995 Sharkey ..... A47G 19/04 220/23.4
6,386,443 B1 * 5/2002 Szczerbinski ..... B65D 5/18 220/23.4
6,394,297 B1 * 5/2002 Nance ..... A47G 19/04 220/23.4
D472,465 S * 4/2003 Nance ..... D7/590
7,980,406 B2 * 7/2011 Liu ..... B65D 67/02 220/23.4
8,418,309 B1 * 4/2013 Williams ..... B44D 3/126 15/257.06
9,119,490 B1 * 9/2015 Parodi, Jr. ..... B65D 25/20
9,493,282 B2 * 11/2016 Nielsen ..... B65D 51/28
2007/0205199 A1 * 9/2007 Wothers ..... B65D 1/265 220/506
2007/0241105 A1 * 10/2007 Nielsen ..... A47G 19/2222 220/23.4
2008/0290089 A1 * 11/2008 Ciarrocchi, Jr. ..... B65D 25/22 220/23.4
2011/0309096 A1 * 12/2011 Jones ..... B65D 75/5872 220/737

* cited by examiner

*Primary Examiner* — Kareen K Thomas
(74) *Attorney, Agent, or Firm* — Eversheds Sutherland (US) LLP

(57) ABSTRACT

A condiment container for mounting to a beverage cup is provided. The condiment cup includes a reservoir for storing a condiment and having at least one aperture capable of providing access to the reservoir for dipping a food item in the condiment. The condiment cup can include a mounting hook configured to extend from the reservoir.

20 Claims, 12 Drawing Sheets

CONDIMENT CONTAINER

CROSS-REFERENCE TO RELATED APPLICATIONS

This application claims priority and benefit of U.S. Provisional Application No. 62/754,083, filed Nov. 1, 2018, which is incorporated by reference herein in its entirety.

TECHNICAL FIELD

The present application relates to condiment packaging that is convenient for traveling. More particularly, the present application is directed to condiment packaging that can hang from a beverage cup rim for on-the-go dipping sauce.

BACKGROUND

Condiment packaging is widely used for storing various sauces. Condiment packaging makes combining food with sauces easy for those on-the-go. Typically, condiment packaging comes in a flexible pouch configured to tear open from one side. The pouches are commonly used to either spread across the top a food product or pour the condiment onto a surface for dipping food products. For example, the pouch may be opened and the sauce squeezed onto a paper bag. While pouring the sauce onto a flat surface may be adequate for dining in a restaurant, this method is extremely inconvenient for traveling.

Accordingly, it is desirable to provide a new condiment package that allows for dipping food products on-the-go.

SUMMARY

Embodiments of the present application address the above-described needs by providing a condiment container for mounting to a beverage cup. The beverage cup includes a cup body for holding a beverage, a beverage cup rim that defines a beverage cup mount, and a removable beverage cup lid. The removable beverage cup lid fits over and seals the beverage cup mouth. The condiment container includes a reservoir for storing a condiment. The reservoir has at least one aperture for providing access to a condiment. The condiment container also includes a mounting hook that extends from the reservoir. The mounting hook has a portion that extends substantially outward and parallel from the aperture. The mounting hook is capable of fitting onto the beverage cup rim and mounting the condiment container to the beverage cup rim so the reservoir is disposed outside and adjacent to the cup body. Additionally, the aperture extends substantially parallel to the beverage cup mouth. The removable beverage cup lid can fit over at least the portion of the mounting hook when the beverage cup lid seals the beverage cup mouth.

Additional aspects will be set forth in part in the description which follows, and in part will be obvious from the description, or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

DETAILED DESCRIPTION

Embodiments of the present application are directed generally to a condiment container. Generally described, a condiment container is provided that forms a reservoir with a hook to grapple onto a beverage cup rim. The containment container is opened in the same direction as the beverage cup rim to limit spilling of the condiment within the reservoir.

Figure 1:
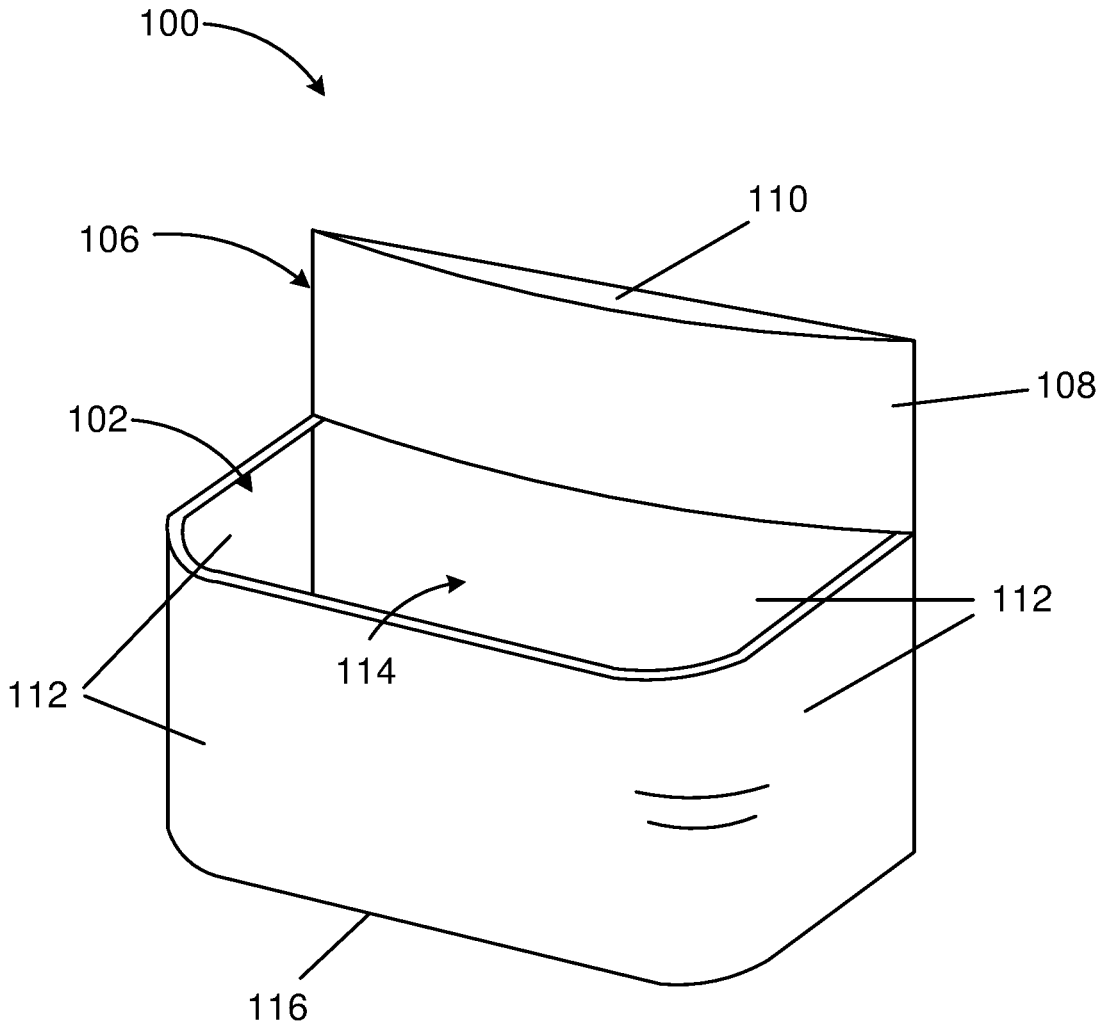
FIG. 1 is a perspective front view of an embodiment of a condiment container.

A first embodiment of a condiment container 100 is illustrated in FIG. 1. The condiment container 100 includes a reservoir 102 and a mounting hook 106 extending away from the reservoir.

The reservoir includes one or more walls 112. The one or more walls 112 define an open end 114 (or "aperture") and an opposite closed end 116 (or "base 116"). From the closed end 116, at least one sidewall may extend perpendicularly from the closed end 116. In some embodiments, the one or more walls 112 may define multiple open ends of the reservoir 102. In some embodiments, the one or more walls 112 may define multiple reservoirs configured to accept and separate different condiments. For example, the one or more walls 112 may include a rounded bowl, or a plurality of substantially straight walls, or five walls, in each example, the one or more walls being configured to hold condiments.

For example, one or more walls 112 may be substantially liquid impermeable. As used herein, "substantially liquid impermeable" means the reservoir 102 can hold liquids so long as liquids do not approach the open end 114 of the reservoir 102.

Figure 5:
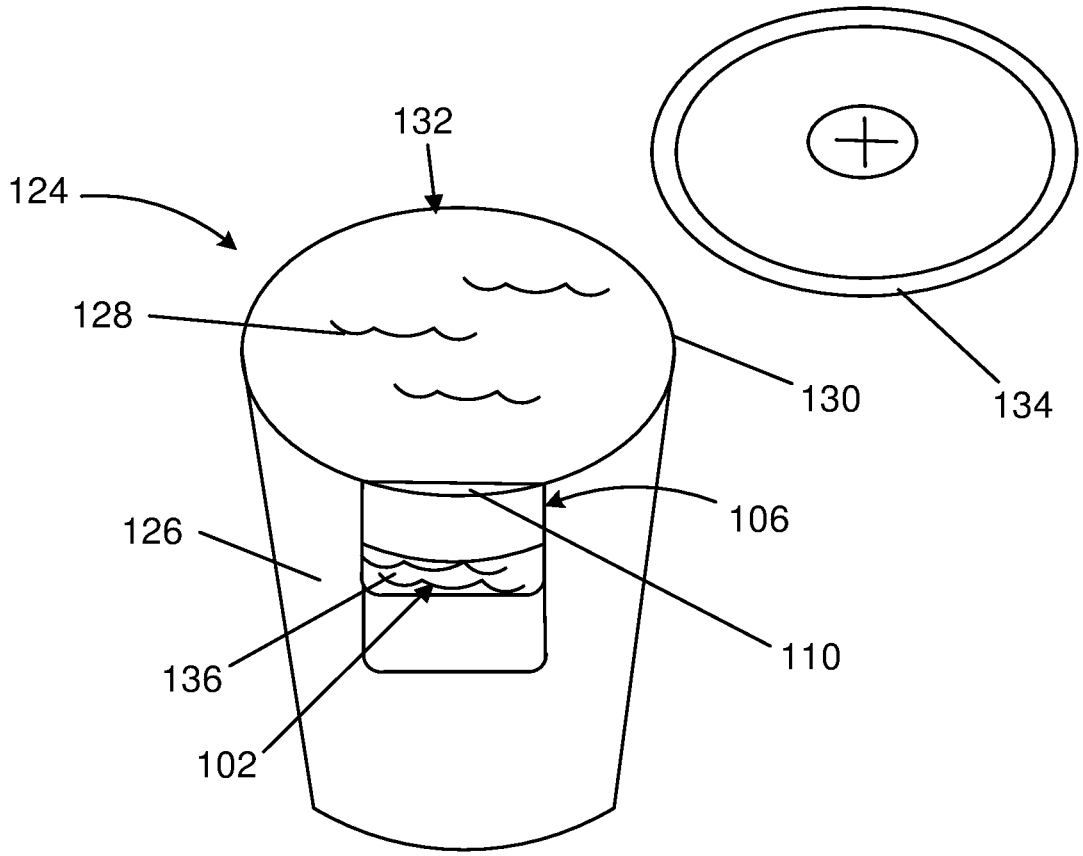
FIG. 5 is a perspective view of an embodiment of a condiment container attached to a beverage cup.

At least one of the one or more walls 112 may arc inward towards the reservoir 102. In some instances, the wall that arcs inward may have a similar curvature as a cup to which the condiment container 100 attaches (e.g., as shown in FIG. 5). In other embodiments, the one or more walls 112 may have rounded edges, squared edges, or some combination therein at the point where the walls connect to the next wall.

The one or more walls 112 may be rigid, flexible, or some combination thereof. For example, the one or more walls 112 may include two walls where one wall is rigid and the other wall is flexible. The condiment container 100 may be made of a plastic, rubber, paper composite, or metal alloy. The condiment container 100 plastic may be polycarbonate, acetal copolymer polyoxymethlene, acetal homopolymer polyoxymethylene, polyethylene, polypropylene, polystyrene, polyvinyl chloride polyolefin, polyethylene teraphthalate, copolymers of polypropylene, copolymers of polyethylene, EVOH, styrene, ABS, PVC, PVDC, copolymers of styrene, multilayer materials, composite materials, bio-derived materials or some combination therein.

Figure 2:
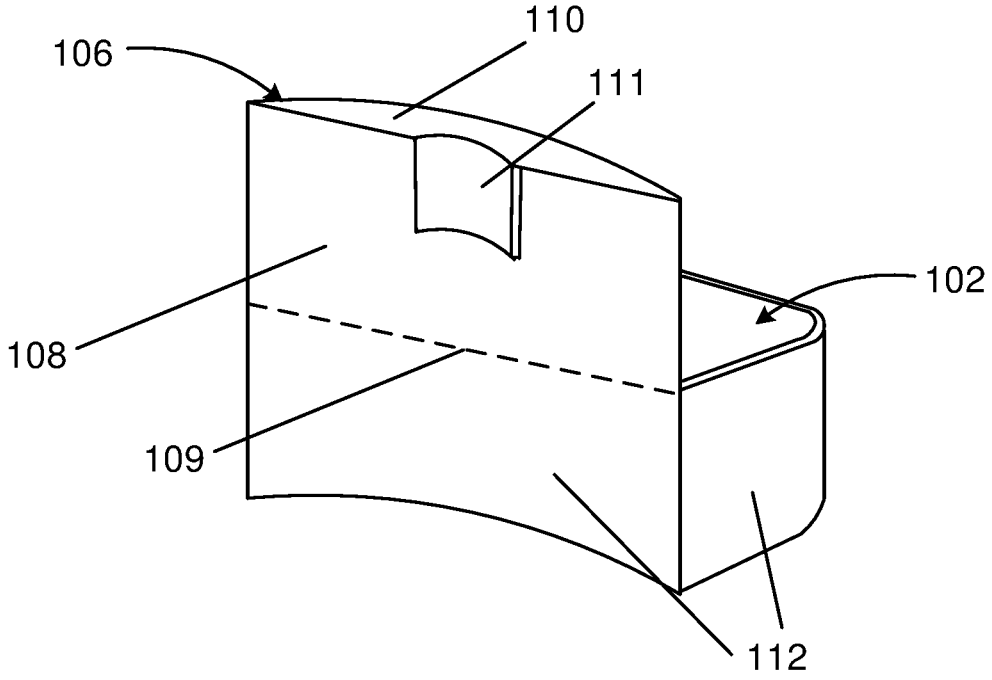
FIG. 2 is a perspective back view of an embodiment of a condiment container.

In some condiment containers 100, the mounting hook 106 is configured to slidably attach onto a beverage cup 124 (e.g., as shown in FIG. 5). The mounting hook 106 may have a first portion 108 that extends away from the open end 114 of the reservoir 102. The mounting hook 106 may be rigid, flexible, or some combination thereof. In some embodiments, the first portion 108 may extend at least partially in a parallel or angled direction away from the one or more walls 112 of the reservoir 102. The first portion 108 of the mounting hook 106, as seen in FIG. 1, is arcuate and bends towards the reservoir 102. The first portion 108 of the mounting hook 106 has substantially the same arc as one wall in the one or more walls 112 to lay flush against a beverage cup. In some embodiments, the first portion 108 may be flat, curve away from the reservoir, or be shaped to fit with another type of beverage cup. As seen in FIGS. 1-4, the first portion 108 may attach to a second portion 110 of the mounting hook 106. The second portion 110 may extend substantially perpendicularly to the first portion 108 of the hook 106 and substantially parallel open end 114 of the condiment container 100. The second portion 110, as seen in FIGS. 1-2, connects to a third portion 111 that extends substantially perpendicularly to the second portion 110 and substantially parallel to the first portion 108 to form the hook 106 for slipping over a beverage cup rim 130 (e.g., as shown in FIG. 5). In other instances, the second portion and third portion may be combined into one portion of the mounting hook 106. The mounting hook 106 first portion 108 and third portion 111 may include at least two substantially parallel walls connected by a substantially perpendicular connector (i.e., second portion 110). For example, the two parallel walls may sandwich a wall of a beverage cup body 126 between the two parallel walls while the perpendicular connector rests on top of the rim 130 of the beverage cup 124 (as shown in FIG. 5). In some instances, the mounting hook 106 may be configured to fold along the dashed line 109. That is, the mounting hook 106 can fold and secure over the reservoir 102. In other examples, the mount hook 106 can fold and secure parallel to the one or more walls 112. In other instances, the mounting hook 106 may be rigid. In some embodiments, the condiment container 100 may be formed through thermoforming. In other instances, the condiment container 100 may be formed through injection molding. The condiment container 100 may be molded into one unitary piece, or the condiment container 100 may be composed of multiple pieces fastened together through heat, adhesive, fasteners, or other attachment method.

As seen in FIG. 2, the first portion 108 of the mounting hook 106 extends substantially parallel from one of the one or more walls 112 of the reservoir 102. The two parallel walls, here the first portion 108 and the third portion 111, may have different surface areas, as illustrated, or may have the same surface area. The mounting hook 106 may be adjustable to fit different beverage cups or may be rigid to fit one type of beverage cup. In some instances, the mounting hook 106 and the reservoir 102 may be one piece to form the condiment container 100. In other instances, the mounting hook 106 and the reservoir 102 may be separate pieces configured to fit together through fasteners, adhesive, joinery, or other attachment method.

Figure 3:
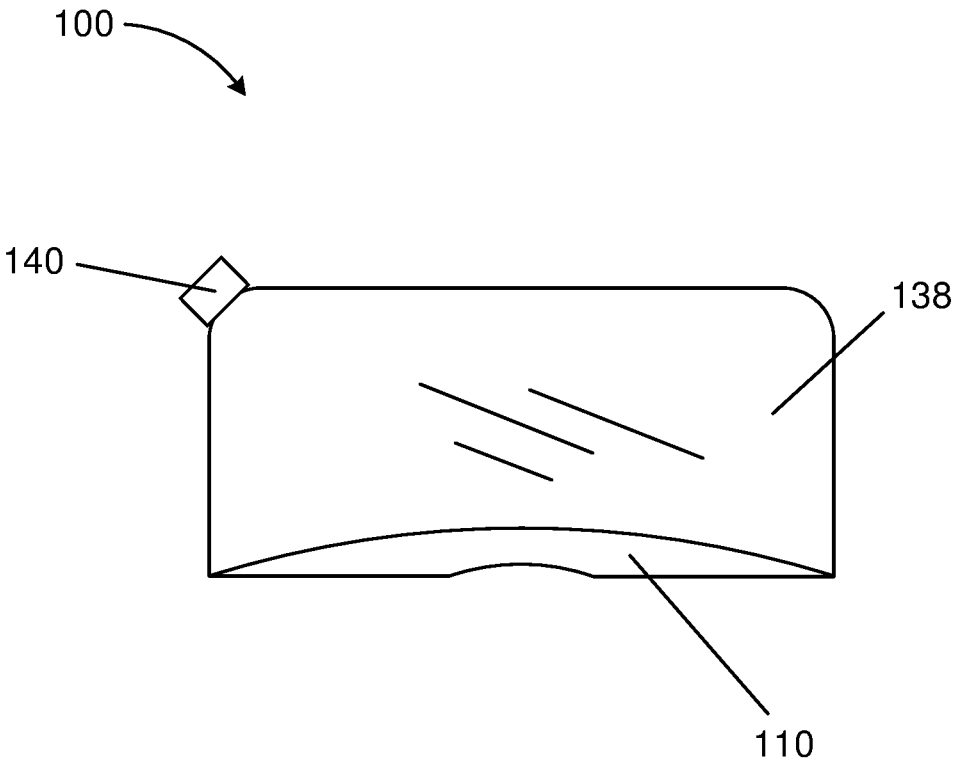
FIG. 3 is a top view of an embodiment of a condiment container.
Figure 4:
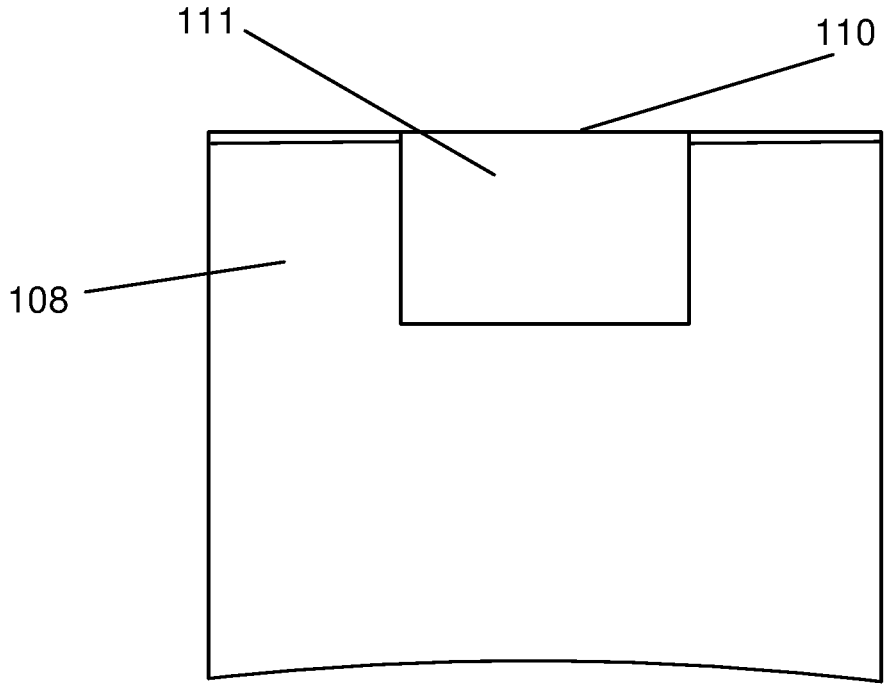
FIG. 4 is a back view of an embodiment of a condiment container.

In one aspect, as shown in FIG. 3, the condiment container 100 includes a condiment container lid 138. The condiment container lid 138 may be an impermeable surface. The condiment container lid 138 may flexible or rigid. In some embodiments, the condiment container lid 138 is configured to detach and reattach after use. As seen in FIG. 3, the condiment container lid 138 has a lid tab 140 for removing the condiment container lid 138. In some embodiments, a condiment is stored within the condiment container 100 and then the condiment container lid 138 is heat sealed to the condiment container 100 for storage. In other embodiments, the condiment container lid 138 may have a weak adhesive or other fastener for securing the condiment container lid 138. For example, the adhesive may be weak enough that a slight force applied to the condiment container lid 138 in perpendicular direction will remove the lid. The lid tab 140 may be of varying shapes or design including a loop, string, flap, or other surface that a user could grapple an edge of the condiment container lid 138 to remove from the condiment container 100. The condiment container lid 138 may be hard to restrict penetration. In other embodiments, the condiment container lid 138 may be a thin flexible plastic to allow for easy removal or penetration. The lid tab 140 may be disposed anywhere along the open end 114 of the reservoir 102.

Figure 6:
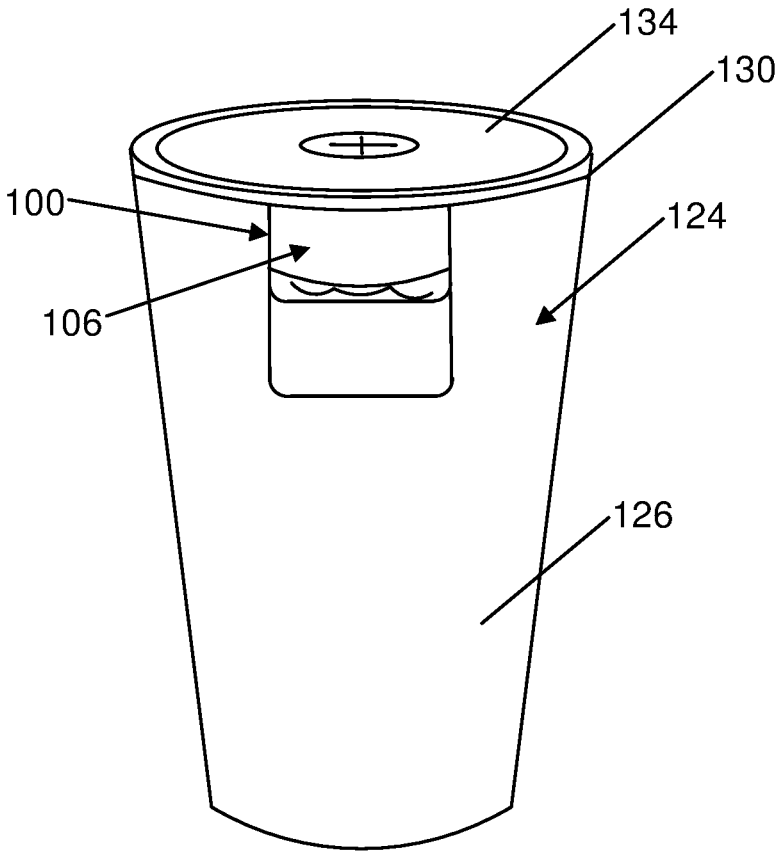
FIG. 6 is a front view of an embodiment of a condiment container attached to a beverage cup.
Figure 7:
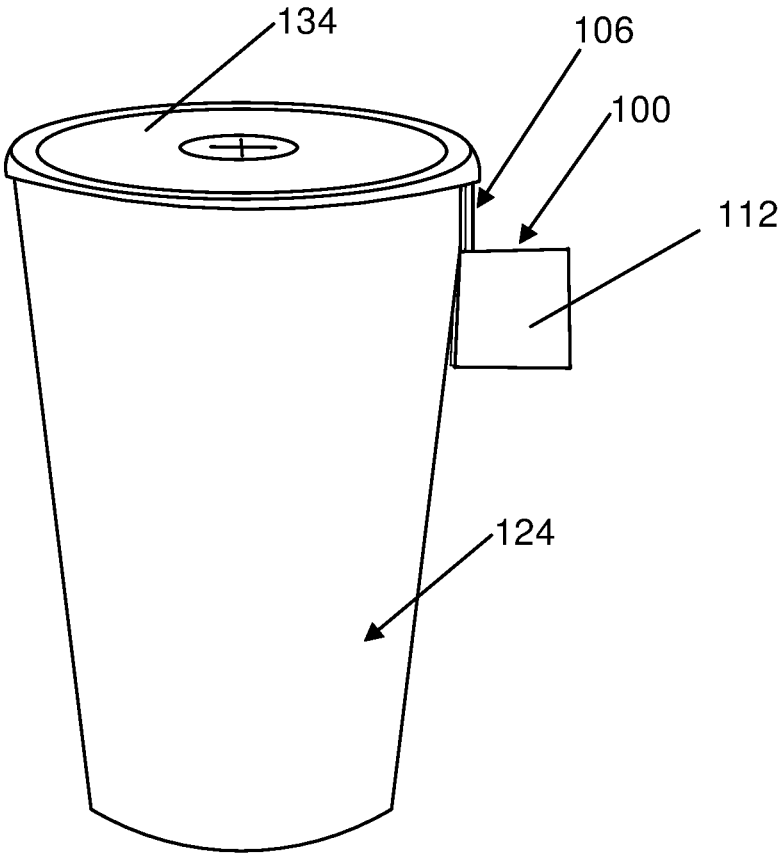
FIG. 7 is a side view of an embodiment of a condiment container attached to a beverage cup.

FIGS. 5 and 6 depict the condiment container 100 mounted onto a beverage cup 124. The beverage cup includes a cup body 126, a beverage cup rim 130, a beverage cup mouth 132, and a removable cup lid 134. The beverage cup rim 130 defines the beverage cup mouth 132. In FIG. 5, the beverage cup rim 130 is a circular rim. In some embodiments, the beverage cup rim 130 may be rectangular, oval, square, or some other shape. The removable cup lid 134 may mimic the shape of the beverage cup rim 130. The beverage cup lid 134 is configured to selectively attach to the beverage cup rim 130 to cover the beverage cup mouth 132. As seen in FIGS. 5 and 6, the condiment container 100 may slide onto the beverage cup rim 130. The second portion 110 of the mounting hook 106 rests flat along the beverage cup rim 130. The mounting hook 106 may be thin enough to allow the beverage cup lid 134 to fit over the second portion 110 of the mounting hook 106 and still seal the beverage 128 within the beverage cup 124. The condiment 136 sits idly in the reservoir 102 of the condiment container 100 for dipping food products such as French fries. With some containers, the mounting hook 106 may puncture the beverage cup lid 134 to rest on top of the beverage cup rim 130. The mounting hook 106 may be configured for various shapes of beverage cup rims. As shown in FIGS. 5 and 6, the mounting hook 106 and condiment container 100 may have arcuate surfaces to sit flush with the surface of the beverage cup body 126. In some embodiments, the condiment container 100 may not match the beverage cup body 126 to sit flush with the surface. The condiment container 100 may sit on the beverage cup rim 130 with the beverage container lid 134 in place over the condiment container 100 mounting hook 106 configured to ensure the beverage 128 cannot spill out of the beverage cup 124.

Figure 8A:
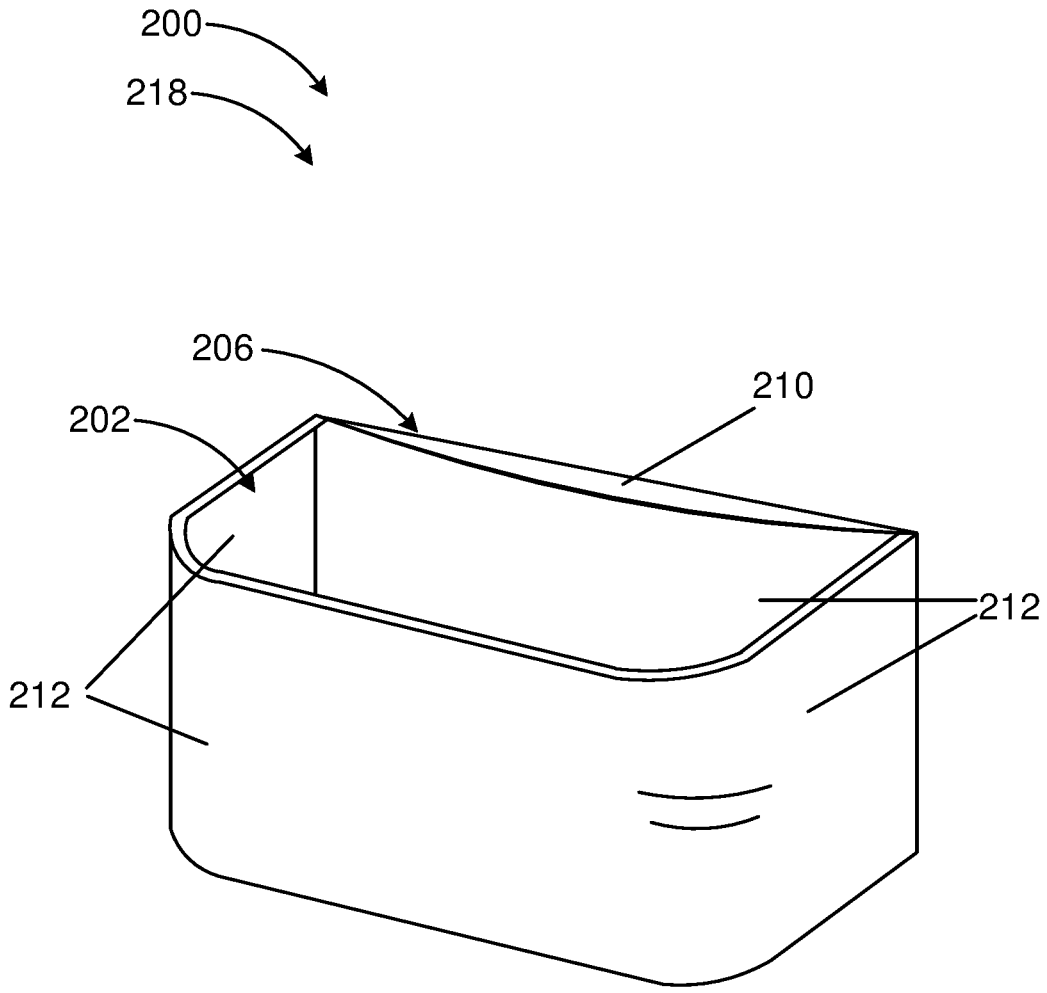
FIG. 8A is a perspective front view of an embodiment of a condiment container in a storage position.
Figure 8B:
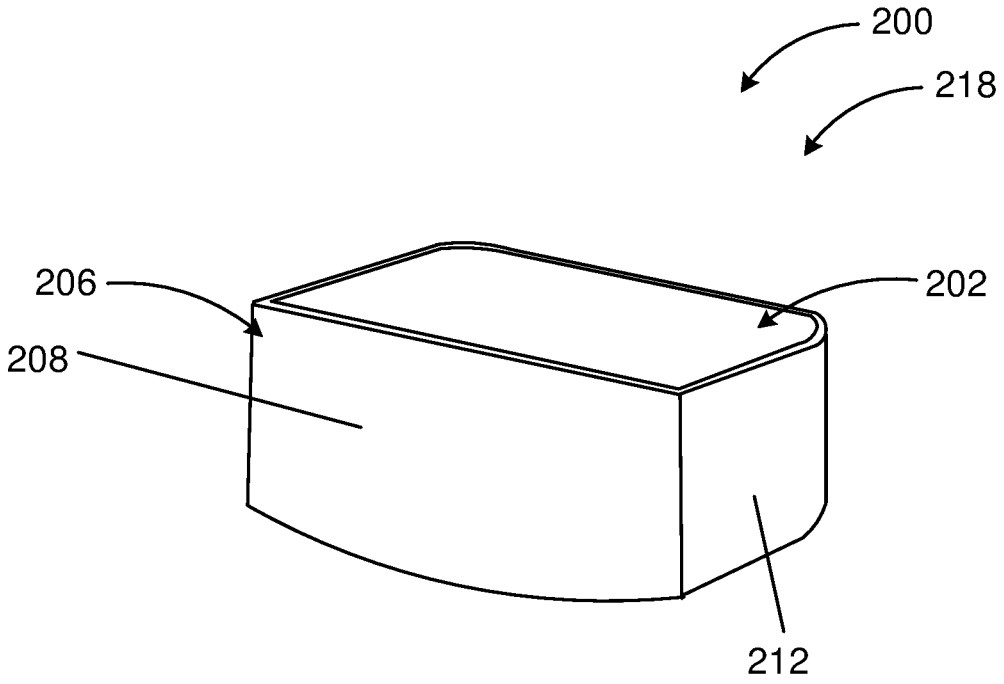
FIG. 8B is a perspective back view of an embodiment of a condiment container in a storage position.

In one aspect, as shown in FIGS. 8A and 8B, the condiment container 200 includes a mounting hook 206 configured to be folded in a plurality of directions. In this manner, the mounting hook 206 (e.g., a similar embodiment shown in FIG. 2) may be in a storage position 218 or in a dipping position (e.g., as shown in FIG. 1). For example, the mounting hook 206 in the storage position 218 may rest against one or more walls 212 of the condiment container 200. That is, the first portion 208 of the mounting hook 206 may fold along one or more edges. In some instances, the first portion 208 may fold along predetermined edges configured to be flexible. In other instances, the flexible edges may be lacerations, thinner material, and/or rotation fasteners. In yet other instances, the mounting hook 206 may be rolled, wrapped, or otherwise stored in a non-extended position along the condiment container 200. The first portion 208 may be configured to fold the mounting hook 206 against the reservoir 202. A user may unfold the first portion 208 to a dipping position (e.g., as shown in FIG. 1) and latch the mounting hook 206 on the beverage cup (e.g., as shown in FIG. 5). In other embodiments, the first portion 208, the second portion 210, and/or the third portion 211 (not shown) may be folded in one or more directions.

Figure 9A:
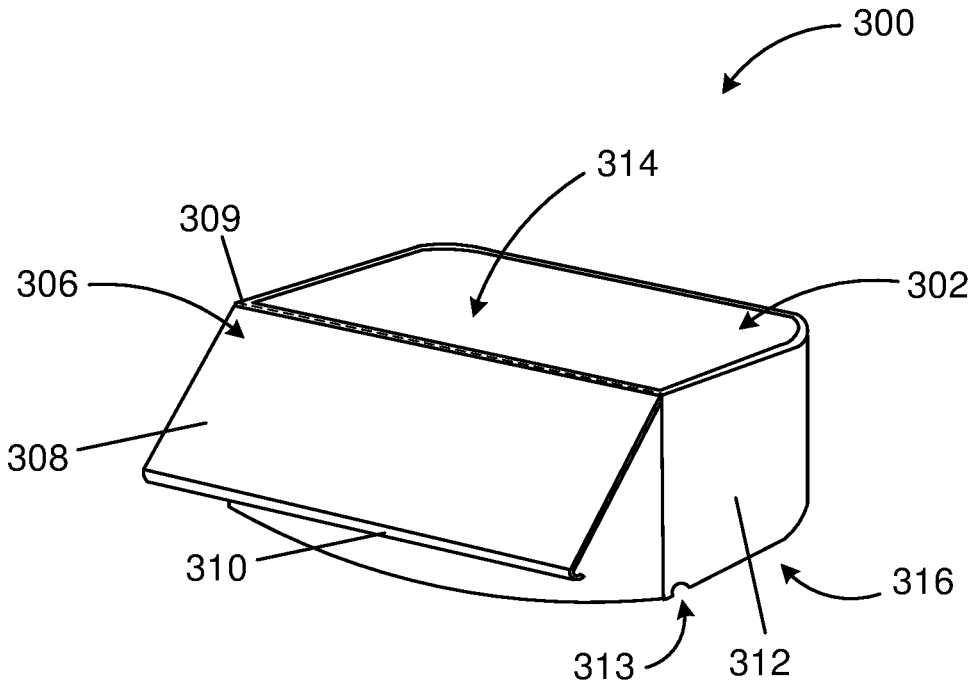
FIG. 9A is a perspective back view of an embodiment of a condiment container between a storage position and a dipping position.
Figure 9B:
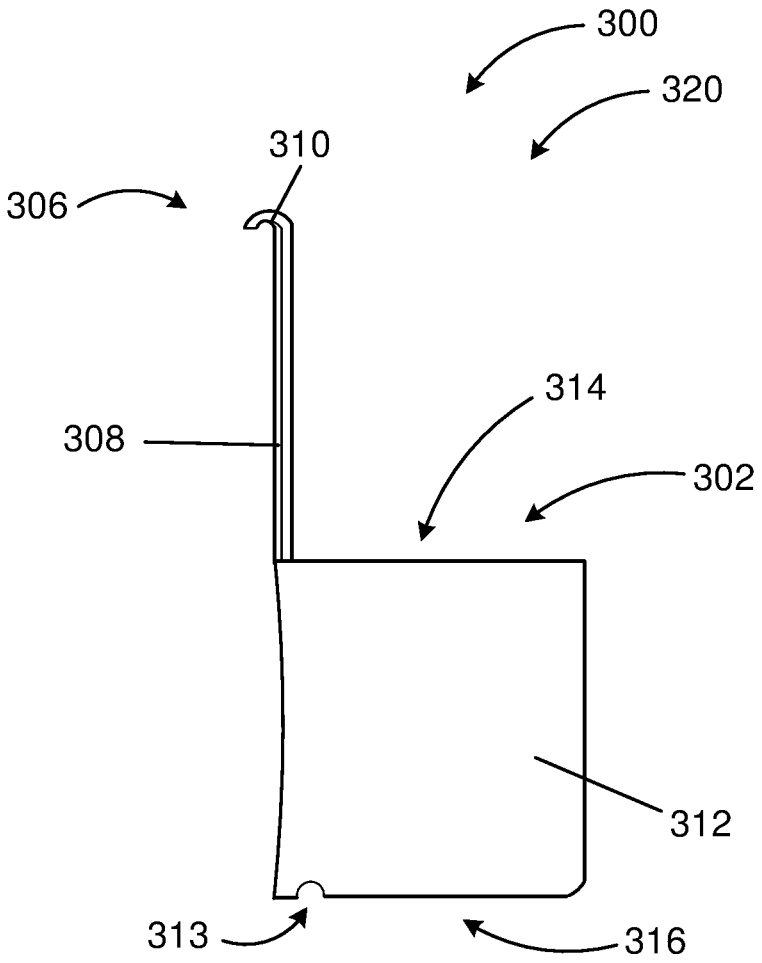
FIG. 9B is a side view of an embodiment of a condiment container in the dipping position.
Figure 9C:
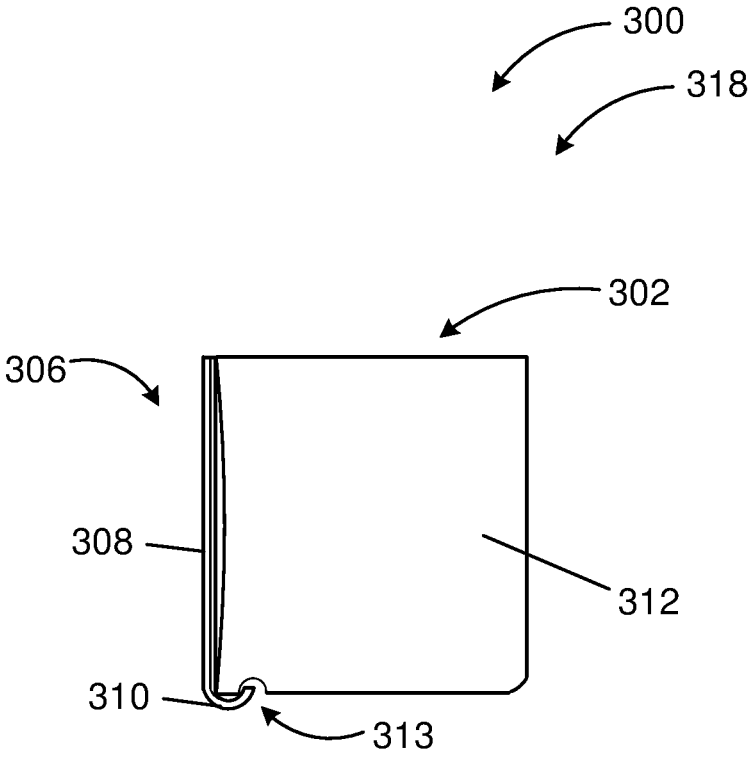
FIG. 9C is a side view of an embodiment of a condiment container in the storage position.

Another embodiment of a condiment container 300 is illustrated in FIGS. 9A-9C. The condiment container 300 includes a reservoir 302 and a mounting hook 306 extending away from the reservoir 302.

The reservoir includes one or more walls 312. The one or more walls 312 define an open end 314 (or "aperture") and an opposite closed end 316 (or "base 316"). The base 316 includes a channel 313 that is a semi-circular cross section that extends across the length of the base 316. In other instances, the channel 313 may be another geometric cross section and extend in a variety of other directions along one or more of the walls 312. From the closed end 316, at least one sidewall may extend perpendicularly from the closed end 316. In some condiment containers, the one or more walls 312 may define multiple open ends of the reservoir 302. In other embodiments, the one or more walls 312 may define multiple reservoirs configured to accept and separate different condiments. For example, the one or more walls 312 may include a rounded bowl, or a plurality of substantially straight walls, or five walls, in each example, the one or more walls being configured to hold condiments.

For example, the one or more walls 312 may be substantially liquid impermeable. As used herein, "substantially liquid impermeable" means the reservoir 302 can hold liquids so long as liquids do not approach the open end 314 of the reservoir 302.

At least one of the one or more walls 312 may arc inward towards the reservoir 302. In some instances, the wall that arcs inward may have a similar curvature as a cup to which the condiment container 300 attaches (e.g., as shown in FIG. 5). In other embodiments, the one or more walls 312 may have rounded edges, squared edges, or some combination therein at the point where the walls connect to the next wall.

The one or more walls 312 may be rigid, flexible, or some combination thereof. For example, the one or more walls 312 may include two walls where one wall is rigid and the other wall is flexible. The condiment container 300 may be made of a plastic, rubber, paper composite, or metal alloy. The condiment container 300 plastic may be polycarbonate, acetal copolymer polyoxymethlene, acetal homopolymer polyoxymethylene, polyethylene, polypropylene, polystyrene, polyvinyl chloride polyolefin, polyethylene teraphthalate, copolymers of polypropylene, copolymers of polyethylene, EVOH, styrene, ABS, PVC, PVDC, copolymers of styrene, multilayer materials, composite materials, bio-derived materials or some combination therein.

In some embodiments, the mounting hook 306 is configured to slidably attach onto a beverage cup 324 (e.g., as shown in FIG. 5). The mounting hook 306 may have a first portion 308 that extends away, in a perpendicular direction, from the open end 314 of the reservoir 302. The mounting hook 306 may be rigid, flexible, or some combination thereof. In some embodiments, the first portion 308 may extend at least partially in a parallel or angled direction away from the one or more walls 312 of the reservoir 302. The first portion 308 of the mounting hook 306 may have substantially the same arc as one wall in the one or more walls 312 to lay flush against a beverage cup. In some condiment containers, the first portion 308 may be flat, curve away from the reservoir, or be shaped to fit with another type of beverage cup. As seen in FIG. 9A, the first portion 308 may extend to a second portion 310. The second portion 310 is substantially c-shaped to form a hook with the first portion 308. The second portion may be another geometric cross-section. The first portion 308 and the second portion 310 form the hook 306 for slipping over a beverage cup rim (e.g., as shown in FIG. 5). The second portion 310 can operably snap into the channel 313 (e.g., the storage position 318). In some instances, the mounting hook 306 may be configured to fold along the dashed line 309. In other instances, the mounting hook 306 may be rigid. In some embodiments, the condiment container 300 may be formed through thermoforming. In other instances, the condiment container 300 may be formed through injection molding. The condiment container 300 may be molded into one unitary piece, or the condiment container 300 may be composed of multiple pieces fastened together through heat, adhesive, fasteners, or other attachment method.

As seen in FIG. 9B, the first portion 308 of the mounting hook 306 extends substantially parallel from one of the one or more walls 312 of the reservoir 302. The mounting hook 306 may be adjustable to fit different beverage cups or may be rigid to fit one type of beverage cup. In some instances, the mounting hook 306 and the reservoir 302 may be one piece to form the condiment container 300. In other instances, the mounting hook 306 and the reservoir 302 may be separate pieces configured to fit together through fasteners, adhesive, joinery, or other attachment method.

In one aspect, as shown in FIGS. 9A-9C, the condiment container 300 includes a mounting hook 306 configured to be folded in a plurality of directions. As shown in FIG. 9B, the mounting hook 306 can be unfolded into a dipping position 320 configured to slide onto a beverage cup rim (e.g., as shown in FIG. 5). As shown in FIG. 9C, the mounting hook 306 can fold back against the condiment container reservoir 302 into the storage position 318. That is, the mounting hook 306 in the storage position 318 rests against the one or more walls 312 of the condiment container 300. In this manner, the first portion 308 of the mounting hook 306 folds along one or more edges to rest against the one or more walls 312. In some instances, the first portion 308 may fold along predetermined edges configured to be flexible. In other instances, the flexible edges may be lacerations, thinner material, and/or rotation fasteners. In yet other instances, the mounting hook 306 may be rolled, wrapped, or otherwise stored in a non-extended position along the condiment container 300. The first portion 308 may be configured to fold the mounting hook 306 against the reservoir 302.

While the disclosure has been described with reference to a number of embodiments, it will be understood by those skilled in the art that the disclosure is not limited to such disclosed embodiments. Rather, the disclosed embodiments can be modified to incorporate any number of variations, alterations, substitutions, or equivalent arrangements not described herein, but which are commensurate with the scope of the disclosure.

I claim:

1. A condiment container for mounting to a beverage cup comprising a cup body for holding a beverage, a beverage cup rim defining a beverage cup mouth, and a removable beverage cup lid for fitting over the beverage cup rim and sealing the beverage cup mouth, the condiment container comprising:

a reservoir for storing a condiment and having at least one aperture capable of providing access to the reservoir for dipping a food item in the condiment; and a mounting hook configured to extend from the reservoir, wherein at least a portion of the mounting hook extends substantially outwardly and parallel to the at least one aperture and the mounting hook is capable of fitting over at least a portion of the beverage cup rim and mounting the condiment container to the beverage cup rim such that the reservoir is disposed outside and adjacent to the cup body, the at least one aperture extends substantially parallel to the beverage cup mouth, and the removable beverage cup lid fits over at least the portion of the mounting hook when the removable beverage cup lid seals the beverage cup mouth.

2. The condiment container of claim 1, the condiment container further comprising a condiment container lid, wherein the condiment container lid seals the at least one aperture and is configured to be removed.

3. The condiment container of claim 1, wherein the reservoir comprises a plurality of walls defining an open end and a closed end, wherein at least one wall of the plurality of walls arcs inwardly towards an interior of the reservoir.

4. The condiment container of claim 3, wherein the plurality of walls are rigid.

5. The condiment container of claim 3, wherein the plurality of walls are flexible.

6. The condiment container of claim 3, wherein the plurality of walls are substantially liquid impermeable.

7. The condiment container of claim 1, wherein the mounting hook comprises, a first wall, wherein the first wall extends substantially perpendicular to the at least one aperture;

a second wall, wherein the second wall couples substantially perpendicular to the first wall; and a third wall, wherein the third wall couples substantially perpendicular to the second wall.

8. The condiment container of claim 1, wherein the condiment container comprises a plastic selected from the group consisting of polycarbonate, acetal copolymer polyoxymethylene, acetal homopolymer polyoxymethylene, polyethylene, polypropylene, polystyrene, polyvinyl chloride polyolefin, polyethylene terephthalate, copolymers of polypropylene, copolymers of polyethylene, EVOH, styrene, ABS, PVC, PVDC, copolymers of styrene, multilayer materials, composite materials, and bioderived materials.

9. The condiment container of claim 3, wherein the plurality of walls include:

a base;

at least one sidewall extending from the base, wherein the at least one sidewall defines a condiment container rim; and the mounting hook is coupled to the condiment container rim, the mounting hook comprising at least two substantially parallel walls connected by a substantially perpendicular connector.

10. The condiment container of claim 9, wherein the at least two parallel walls of the condiment container comprise a first wall and a second wall, the second wall having less surface area than the first wall.

11. The condiment container of claim 9, wherein the hook is configured to slide onto the beverage cup rim.

12. The condiment container of claim 9, wherein the at least two parallel walls have the same surface area.

13. The condiment container of claim 9, wherein the at least two parallel walls arc inwardly towards the at least one sidewall.

14. The condiment container of claim 9, the cup further comprising a condiment container lid, the condiment container lid configured to affix to the condiment container rim, wherein the condiment container lid is substantially liquid impermeable.

15. The condiment container of claim 2, wherein the reservoir further comprises a flange surrounding the at least one aperture and the condiment container lid is removably adhered to the flange.

16. The container of claim 15, wherein the condiment container lid is heat sealed to the flange or adhered to the flange with an adhesive.

17. The condiment container of claim 1, wherein the mounting hook comprises at least two substantially parallel curved walls and a substantially perpendicular cross-member, one of the at least two substantially parallel curved walls couples to at least one sidewall of the reservoir, and the substantially perpendicular cross-member connects the two substantially parallel curved walls, wherein the mounting hook is configured to fold.

18. The condiment container of claim 17, wherein the mounting hook is selectively positionable between:

a storage position, wherein the mounting hook is folded against the container; and a dipping position, wherein the mounting hook is extended away from the aperture to mount onto the beverage cup.

19. A condiment container for mounting to a beverage cup comprising a cup body for holding a beverage, a beverage cup rim defining a beverage cup mouth, and a removable beverage cup lid for fitting over the beverage cup rim and sealing the beverage cup mouth, the condiment container comprising:

a reservoir for storing a condiment and having at least one aperture capable of providing access to the reservoir for dipping a food item in the condiment; and a mounting hook configured to extend from the reservoir, wherein the mounting hook is selectively positionable between:

a storage position, wherein the mounting hook is folded against the condiment container; and a dipping position, wherein the mounting hook is extended away from the aperture to mount onto a beverage cup, wherein when the mounting hook is positioned in the dipping position, the mounting hook is configured for and capable of fitting over at least a portion of the beverage cup rim and mounting the condiment container to the beverage cup rim such that the reservoir is disposed outside and adjacent to the cup body, the at least one aperture extends substantially parallel to the beverage cup mouth, and the removable beverage cup lid fits over at least the portion of the mounting hook when the removable beverage cup lid seals the beverage cup mouth.

20. A condiment container for mounting to a beverage cup comprising a cup body for holding a beverage, a beverage cup rim defining a beverage cup mouth, and a removable beverage cup lid for fitting over the beverage cup rim and sealing the beverage cup mouth, the condiment container comprising:

a reservoir for storing a condiment and having at least one aperture capable of providing access to the reservoir for dipping a food item in the condiment; and a mounting hook attached to the reservoir, the mounting hook comprising:

a first wall, wherein the first wall extends substantially perpendicular to the at least one aperture;

a second wall, wherein the second wall couples substantially perpendicular to the first wall; and a third wall, wherein the third wall couples substantially perpendicular to the second wall, wherein the mounting hook is configured for and capable of fitting over at least a portion of the beverage cup rim and mounting the condiment container to the beverage cup rim such that the reservoir is disposed outside and adjacent to the cup body, the at least one aperture extends substantially parallel to the beverage cup mouth, and the removable beverage cup lid fits over at least the portion of the mounting hook when the removable beverage cup lid seals the beverage cup mouth.

* * * * *